United States Patent [19]

Oikawa et al.

[11] Patent Number: 4,911,112

[45] Date of Patent: Mar. 27, 1990

[54] VALVE OPERATING SYSTEM FOR INTERNAL COMBUSTION ENGINES

[75] Inventors: Toshihiro Oikawa; Noriyuki Yamada; Toshiki Kobayashi; Tsuneo Tanai; Tsutomu Saka, all of Saitama, Japan

[73] Assignee: Honda Giken Kogyo Kabushiki Kaisha, Tokyo, Japan

[21] Appl. No.: 290,171

[22] Filed: Dec. 27, 1988

[30] Foreign Application Priority Data

| | | | |
|---|---|---|---|
| Dec. 28, 1987 | [JP] | Japan | 62-336596 |
| Dec. 28, 1987 | [JP] | Japan | 62-200639[U] |
| Oct. 11, 1988 | [JP] | Japan | 63-132445[U] |

[51] Int. Cl.[4] ..... F01L 1/18; F01L 1/34

[52] U.S. Cl. ..... 123/90.16; 123/90.44

[58] Field of Search ..... 123/90.15, 90.16, 90.17, 123/90.27, 90.39, 90.44

[56] References Cited

U.S. PATENT DOCUMENTS

| | | | |
|---|---|---|---|
| 4,727,831 | 3/1988 | Nagahiro et al. | 123/90.16 |
| 4,759,322 | 7/1988 | Konno | 123/90.16 |
| 4,765,289 | 8/1988 | Masuda et al. | 123/90.16 |
| 4,768,475 | 9/1988 | Ikemura | 123/90.16 |
| 4,787,346 | 11/1988 | Ajiki et al. | 123/90.16 |
| 4,807,574 | 2/1989 | Shibata et al. | 123/90.16 |
| 4,829,948 | 5/1989 | Yoshida et al. | 123/90.16 |

*Primary Examiner*—Willis R. Wolfe

*Assistant Examiner*—Weilun Lo

*Attorney, Agent, or Firm*—Lyon & Lyon

[57] ABSTRACT

A valve operating system for internal combustion engines comprises a free cam follower which is disposed between first and second drive cam followers operatively connected to engine valves and which is capable of becoming free relative to the engine valves, first and second guide holes respectively provided in the first and second drive cam followers with their axes corresponding to each other. The guide holes is opened to the free cam follower. A double open-ended guide hole is provided in the free cam follower in correspondence to the axes of the first and second guide holes. A first change-over pin is axially slidably received in the first guide hole and adapted to be fitted into the guide hole, and a second change-over pin is axially slidably received in said guide hole with one end thereof abutting against the first change-over pin, and is adapted to be fitted into said second guide hole. A restricting pin is axially slidably received in said second guide hole while being spring-biased toward said second change-over pin, with one end thereof abutting against the other end of said second change-over pin. This construction ensures that fitting of the first change-over pin into the guide hole as well as fitting of the second change-over pin into the second guide hole can be reliably performed.

7 Claims, 11 Drawing Sheets

VALVE OPERATING SYSTEM FOR INTERNAL COMBUSTION ENGINES

BACKGROUND OF THE INVENTION

1. Field of the invention

The present invention relates to a valve operating system for internal combustion engines, comprising a free cam follower which is disposed between first and second drive cam followers operatively connected to engine valves and which is capable of becoming free relative to the engine valves, first and second guide holes respectively provided in the first and second drive cam followers with their axes corresponding to each other, the guide holes being opened to the free cam follower, a double open-ended guide hole provided in the free cam follower in correspondence to the axes of the first and second guide holes, a first change-over pin axially slidably received in the first guide hole and adapted to be fitted into the guide hole, a second change-over pin axially slidably received in the guide hole with one end thereof abutting against the first change-over pin, the second change-over pin being adapted to be fitted into the second guide hole, and a restricting pin axially slidably received in the second guide hole while being spring-biased toward the second change-over pin, with one end thereof abutting against the other end of the second change-over pin.

2. Description of the prior art

Such system is conventionally known, for example, from Japanese Patent Application Laid-open No. 19911/86 and the like.

In such valve operating system, the first and second drive cam followers as well as the free cam follower are connected by fitting of the first change-over pin into the free cam follower and fitting of the second change-over pin into the second drive cam follower. In order to prevent impossibility of connection due to striking of the first and second change-over pins against sides of the free cam follower and the second drive cam follower during such connecting operation, the accuracy of inside diameters of the first and second guide holes and the accuracy of outside diameters of the pins have been controlled to μm. Even if the single part accuracies of the cam followers and the pins are improved, however, dimensional tolerances between the parts mutually associated are accumulated on assembling and as a result, the operation of connection by the first and second change-over pins may be impossible in some cases.

SUMMARY OF THE INVENTION

The present invention has been accomplished with such circumstances in view, and it is an object of the present invention to provide a valve operating system for internal combustion engines, in which the operation of connection of the cam followers by the first and second change-over pins is reliably performed.

To attain such object, according to the present invention, the guide hole is formed to have an inside diameter larger than those of the first and second guide holes.

With the above construction, even if there is an accumulation of the dimensional tolerances between parts associated with the cam followers, it is possible to reliably perform fitting of the first change-over pin into the guide hole as well as fitting of the second change-over pin into the second guide hole.

It is another object of the present invention to provide a valve operating system for internal combustion engines, in which the amounts of relatively swinging movements of the cam followers are restricted to prevent falling-off of the parts from the cam followers during maintenance and the like.

The above and other objects, features and advantages of the invention will become apparent from a reading of the following description of the preferred embodiment, taken in conjunction with the accompanying drawings.

BRIEF DESCRIPTION OF THE DRAWINGS

FIGS. 1 to 11 illustrate one embodiment of the present invention, wherein FIG. 1 is a plan view of a valve operating system for internal combustion engine according to one embodiment of the present invention;

FIG. 2 is a sectional view taken along a line II—II in FIG. 1;

FIG. 3 is a sectional view taken along a line III—III in FIG. 1;

FIG. 4 is an enlarged sectional view taken along a line IV—IV in FIG. 2;

FIG. 5 is an enlarged view of a portion indicated by V in FIG. 4;

Figure 2:
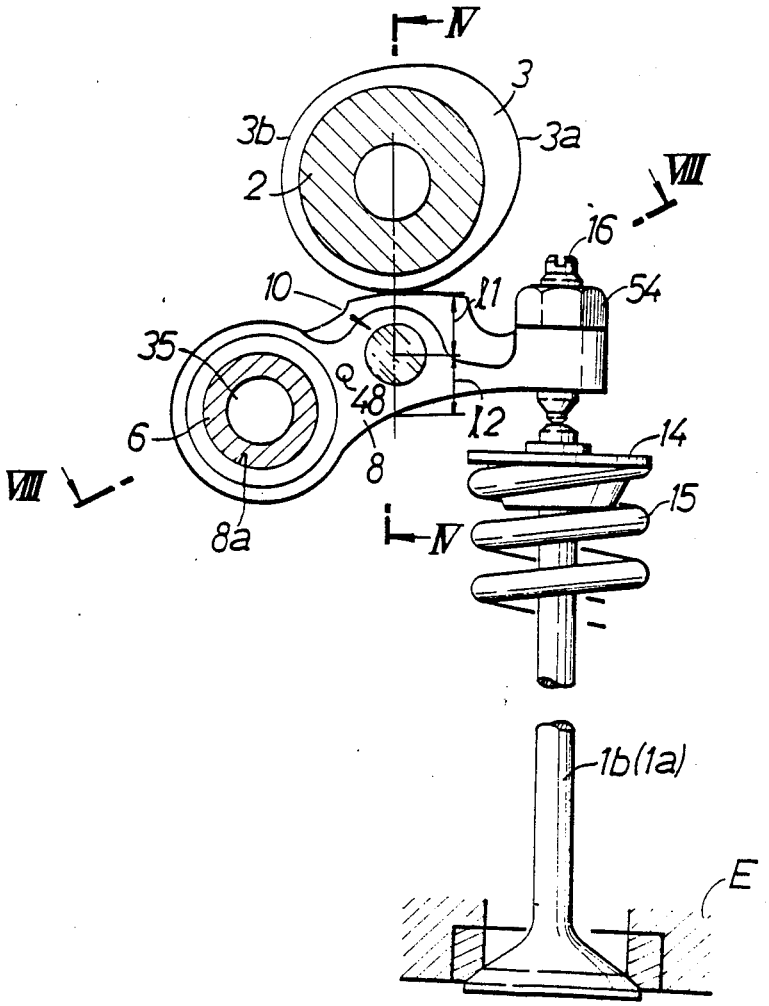
Figure 6:
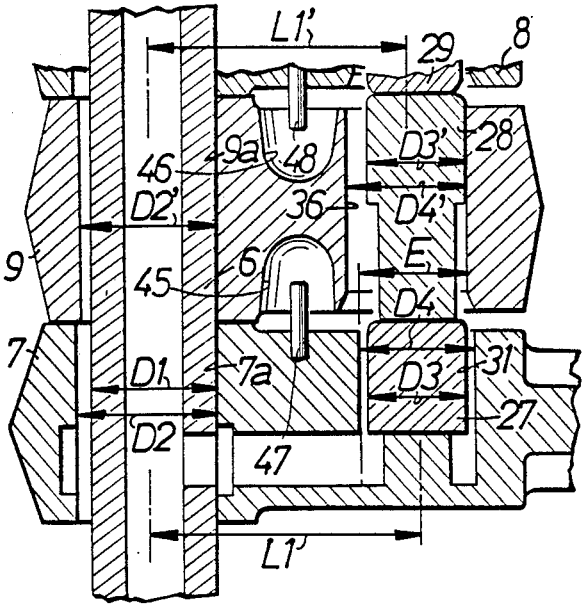
Figure 6A:
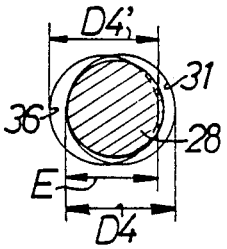
Figure 6B:
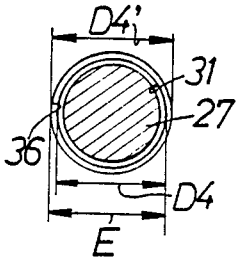
Figure 6C:
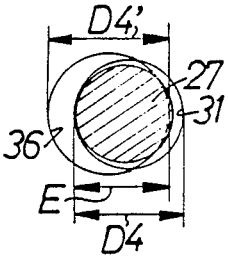
Figure 7:
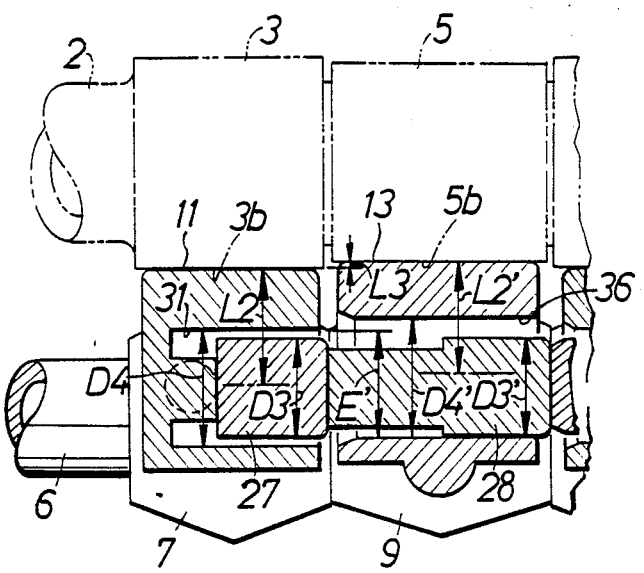
Figure 7A:
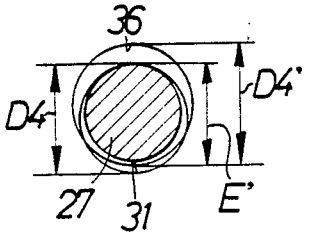
Figure 8:
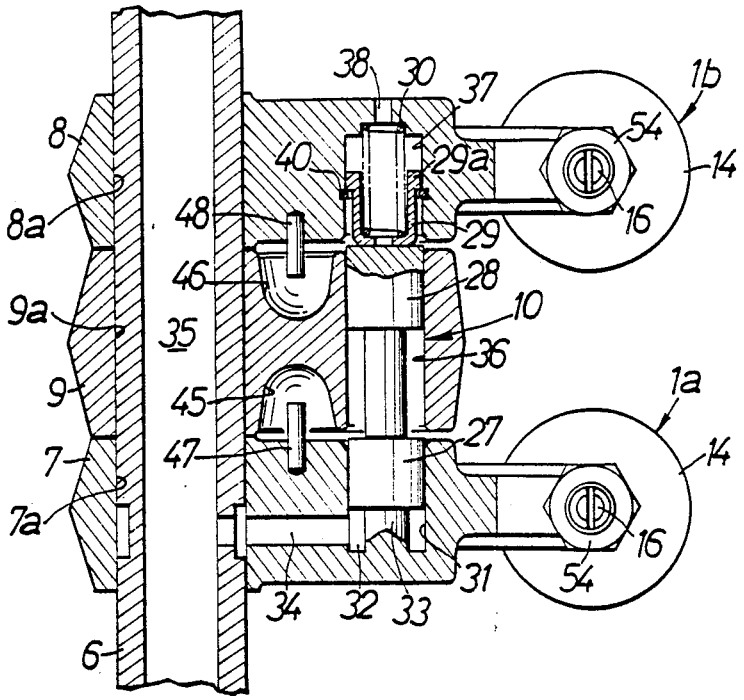
Figure 9:
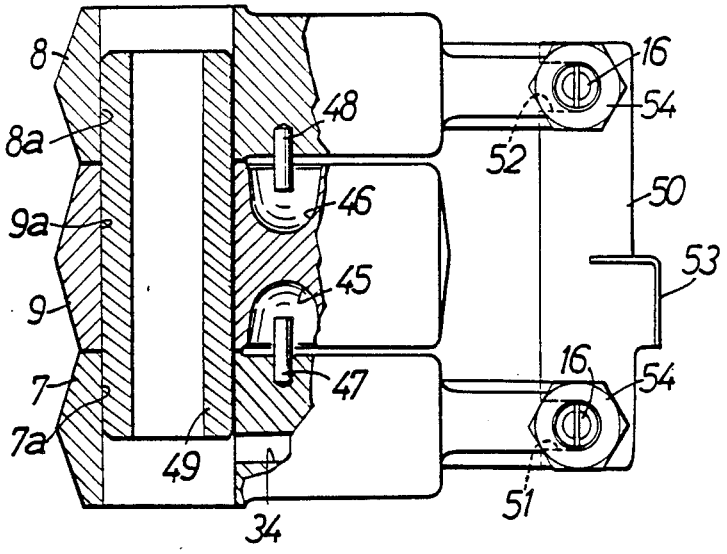
Figure 10:
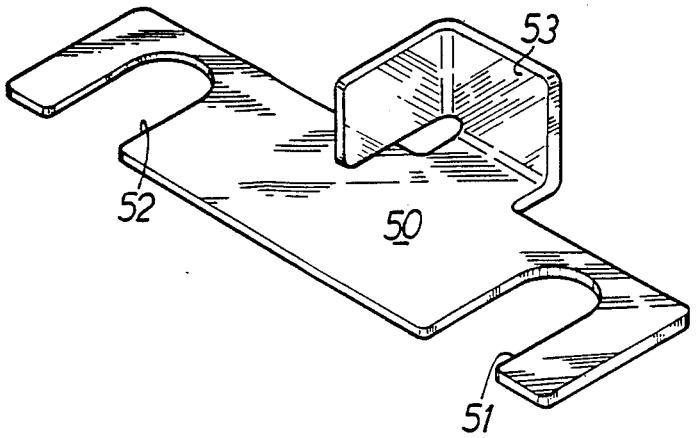
Figure 11:
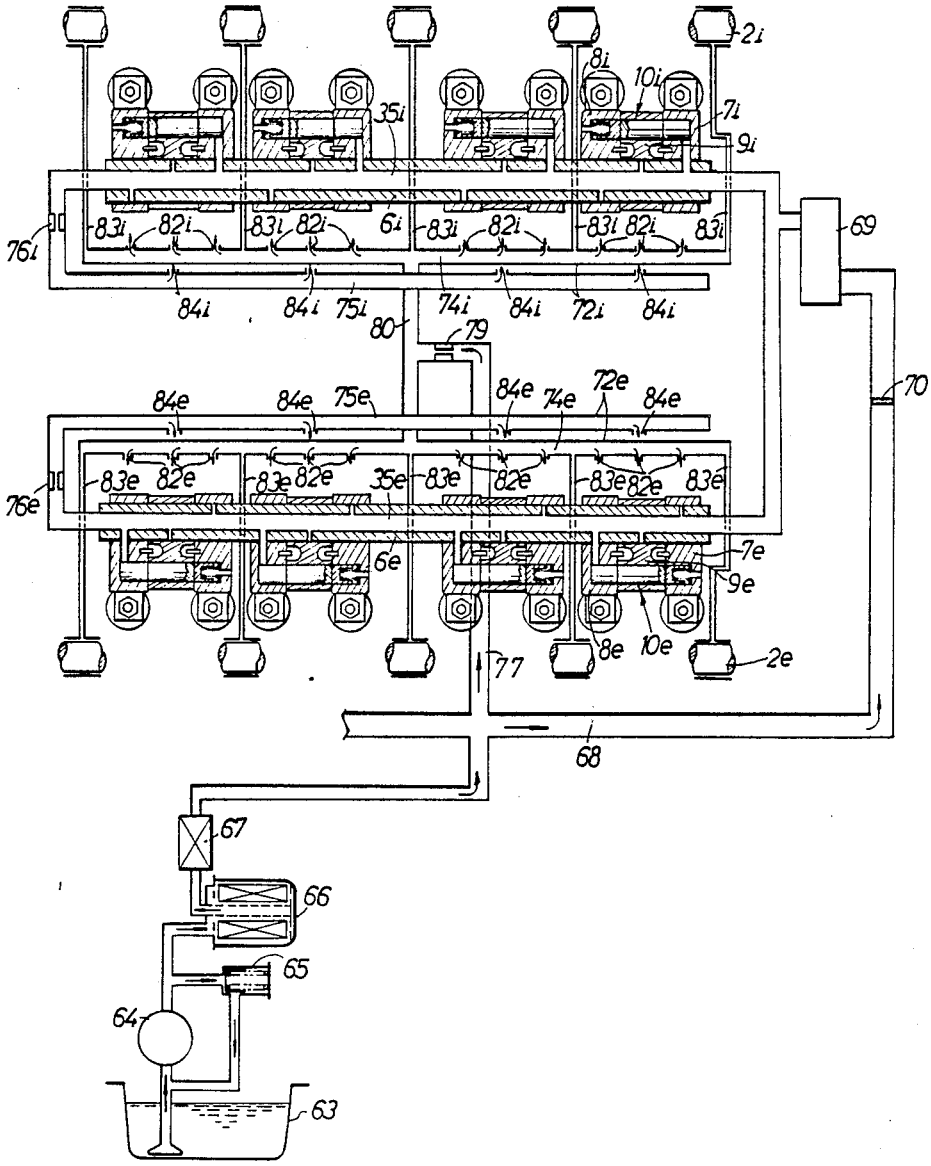

FIG. is a cross-sectional schematic plan view for illustrating the dimensions of portions associated with a rocker shaft;

FIG. 6A, 6B and 6C are longitudinal sectional schematic views for illustrating a misalignment between a first guide hole and a guide hole, respectively;

FIG. 7 is a cross-sectional schematic plan view for illustrating portions associated with a cam shaft;

FIG. 7A is a longitudinal sectional view for illustrating a misalignment between the first guide hole and the guide hole;

FIG. 8 is a sectional view taken along a line VIII—VIII in FIG. 2;

FIG. 9 is a plan view of a rocker arm mounted into a unit construction on assembling;

FIG. 10 is an enlarged perspective view of an assembling jig;

FIG. 11 is a diagram of an oil supplying system; and

Figure 12:
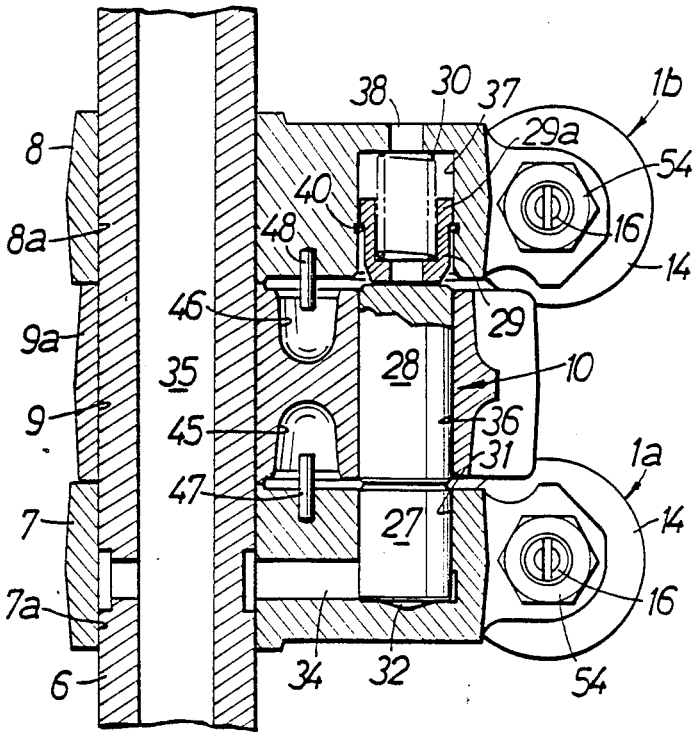

FIG. 12 is a sectional view similar to FIG. 8, but illustrating another embodiment of the present invention.

DESCRIPTION OF THE PREFERRED EMBODIMENTS

The present invention will now be described by way of embodiments with reference to the accompanying drawings.

Figure 1:
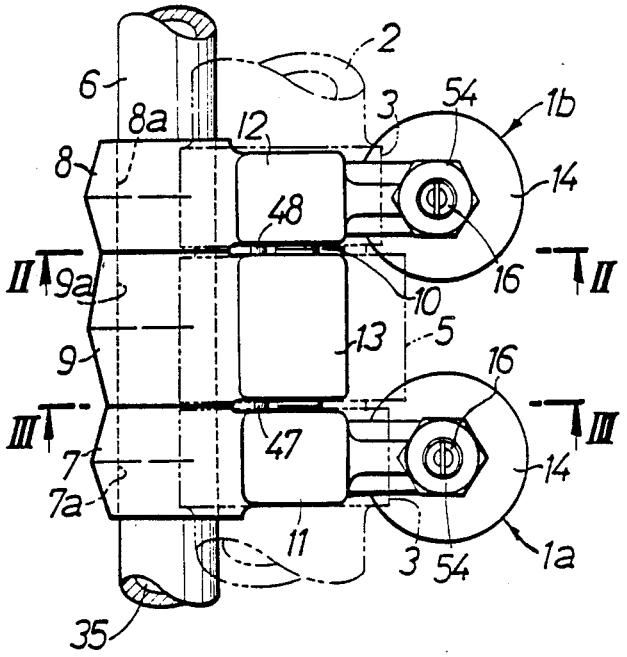
Figure 3:
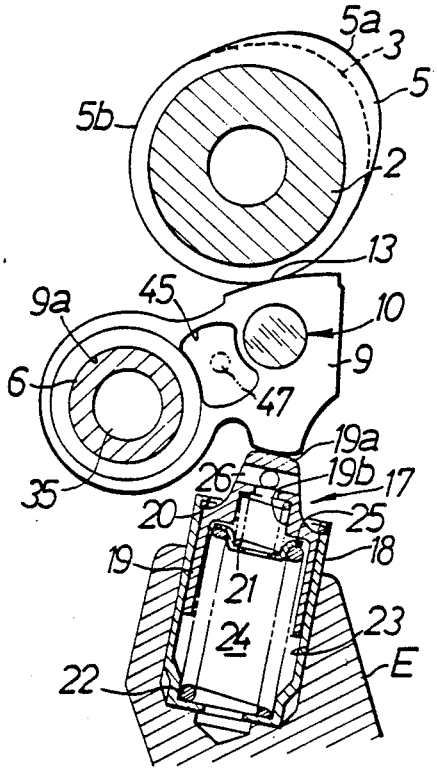

One embodiment of the present invention will be described below with reference to FIGS. 1 to 11. Referring first to FIGS. 1, 2 and 3, a pair of engine valves 1*a* and 1*b*, i.e., a pair of intake valves or exhaust valves provided in an engine body E are driven to be opened and closed by operations of lower speed cams 3 and 3 and a higher speed cam 5 integrally provided on a cam shaft 2 rotatively driven at a reduction ratio of $\frac{1}{2}$ from a crank shaft of an engine, first and second drive rockers arms 7 and 8 as first and second drive cam followers and a free rocker arm 9 as a free cam follower, which are pivotally mounted on a rocker shaft 6 parallel to the cam shaft 2, and a connection change-over mechanism 10 provided between the rocker arms 7 to 9.

The cam shaft 2 is rotatably disposed above the engine body E, and the lower speed cams 3 are integral with the cam shaft 2 at places corresponding to the engine valves 1*a* and 1*b*, respectively, while the higher speed cam 5 is integral with the cam shaft 2 between the lower speed cams 3 and 3. Each of the lower speed cams 3 has a raised portion 3*a* having a relatively small amount raised radially of the cam shaft 2, and a circular base portion 3*b*. The higher speed cam 5 also has a raised portion 5*a* having a larger amount raised outwardly radially of the cam shaft 2 than that of the raised portion 3*a* and extending in an extent of a central angle wider than that of the raised portion 3*a*, and a circular base portion 5*b*.

The rocker shaft 6 is fixedly disposed below the cam shaft 2. The first drive rocker arm 7 operatively connected to one of the engine valves 1*a*, the second drive rocker arm 8 operatively connected to the other engine valve 1*b*, and the free rocker arm 9 disposed between the first and second drive rocker arms 7 and 8 are adjacently, pivotally mounted on the rocker shaft 6 which is inserted through support holes 7*a*, 8*a* and 9*a* made in the corresponding rocker arms 7 to 9.

A cam slipper 11 is provided on an upper portion of the first drive rocker arm 7 in slidable contact with the one lower speed cam 3, while a cam slipper 12 is on an upper portion of the second drive rocker arm 8 in slidable contact with the other lower speed cam 3. A cam slipper 13 is provided on an upper portion of the free rocker arm 9 in slidable contact with the higher speed cam 5.

On the other hand, a collar 14 is mounted on an upper portion of each of the engine valves 1*a* and 1*b*, and a valve spring 15 is interposed between each of the collars 14 and the engine body E, so that each of the engine valves 1*a* and 1*b* may be biased in a closing direction, i.e., upwardly by the valve spring 15. A tappet screw 16 is advanceably and retreatably, threadedly inserted in a leading end of each of the first and second drive rocker arms 7 and 8 to abut against an upper end of each of the engine valves 1*a* and 1*b*. A nut 54 is screwed over the tappet screw 16 and abutttable against the front of each of the first and second drive rocker arms 7 and 8.

The free rocker arm 9 slightly extends from the rocker shaft 6 toward the engine valves 1*a* and 1*b* and is resiliently biased in a direction of slidable contact with the higher speed cam by a lost motion mechanism 17 which is interposed between the engine body E.

The lost motion mechanism 17 comprises a bottomed cylindrical guide member 18 fitted in the engine body E with its closed end located closer to the engine body E, a piston 19 slidably received in the guide member 18 and having an abutment 19 which is formed in a tapered manner at its end closer to the free rocker arm 9 to abut against the free rocker arm 9, a stopper 20 detachably secured to an inner surface of the guide member 18 closer to its opened end to engage the piston 19, and a first and second springs 21 and 22 interposed between the piston 19 and the guide member 18 to resiliently bias the piston 19 in a direction to abut against the free rocker arm 9.

The engine body E is provided with a bottomed mounting hole 23 into which the guide member 18 is fitted. A spring chamber 24 is defined between the piston 19 and the guide member 18, and a first spring 21 having a relatively small spring constant is provided in compression between a retainer 25 contained in the spring chamber 24 and the piston 19, while a second spring having a relatively large spring constant is provided in compression between the retainer 25 and the closed end of the guide member 18.

A small diameter bottomed hole 19*b* is made in an inner surface at the closed end of the piston 19, and the first spring 21 having a relatively small spring constant is contained in the small diameter hole 19*b*, thereby preventing falling of the first spring 21. In addition, the abutment 19*a* of the piston 19 is also provided with an air vent hole 26 made in a cross-shape and opened in an outer surface of the abutment 19*a* to put the spring chamber 24 into communication with the outside in order to prevent the interior of the spring chamber 24 from being pressurized and depressurized during sliding operation of the piston 19.

The stopper 20 is a retaining ring having an abutment and is detachably fitted to an inner surface of the guide member 18 closer to the opened end thereof. Furthermore, the stopper 20 is abuttable against a base end of the abutment 19*a* of the piston 19, thereby inhibiting slipping of the piston 19 out of the guide member 18.

Figure 4:
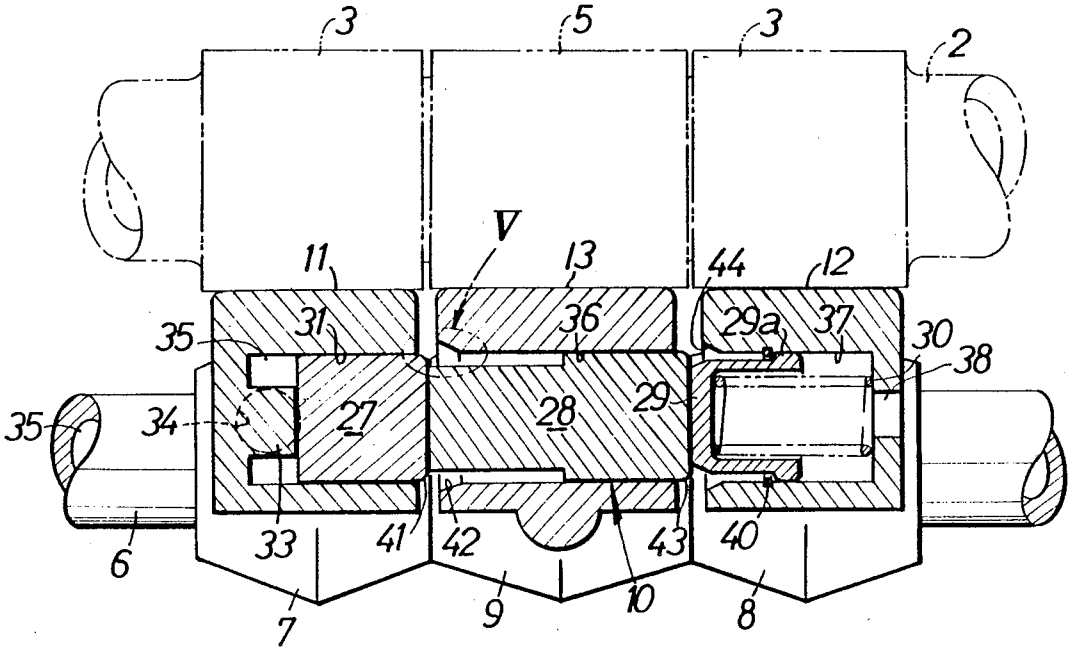

Referring to FIG. 4, the connection change-over mechanism 10 is provided between the rocker arms 7 to 9 for changing over the connection and disconnection between them. The connection change-over mechanism 10 comprises a first change-over pin 27 capable of connecting the first drive rocker arm 7 and the free rocker arm 9, a second change-over pin 28 capable of connecting the free rocker arm 9 and the second driver rocker arm 8, a restricting pin 29 for restricting the movements of the first and second change-over pins 27 and 28, and a return spring 30 for biasing the pins 27 to 29 to disconnecting positions.

The connection change-over mechanism 10 is provided on the rocker arms 7, 8 and 9 at a location corresponding to the cam slippers 11, 12 and 13, as shown in FIG. 2, and has an axis C which is disposed so that a distance $l_1$ between slidable contact portions of the cams 3, 3 and 5 with the cam slippers 11 to 13 and the axis C may be substantially identical with a distance $l_2$ between lower surfaces of the rocker arms 7–9 and the axis C on an extension of a line connecting the slidable contact portions with a center of the cam shaft 2.

A first bottomed guide hole 31 is provided in the first drive rocker arm 7 in parallel to the rocker shaft 6 and opened to the free rocker arm 9, and the first change-over pin 27 formed into a solid column-like configuration is slidably received in the first guide hole 31. A hydraulic pressure chamber 32 is defined between one end of the first change-over pin 27 and a closed end of the first guide hole 31. Further, the first guide hole 31 is provided at the closed end thereof with a restricting projection 33 for restricting the movement of the first change-over pin 27 toward one end. The first drive rocker arm 7 is provided with a communication passage 34 communicating with the hydraulic pressure chamber 32, and a oil feed passage 35 is provided in the rocker shaft 6 and normally communicates with the communication passage 34 and thus with the hydraulic pressure chamber 32 irrespective of swinging movement of the first drive rocker arm 7.

A guide hole 36 is provided in the free rocker arm 9 in correspondence to the first guide hole 31 to extend between opposite sides in parallel to the rocker shaft 6, and the second change-over pin 28 permitted to abut at one end thereof against the other end of the first change-over pin 27 is slidably received in te guide hole 36. The second change-over pin 28 is also formed into a solid column-like configuration.

A second bottomed guide hole 37 is made in the second drive rocker arm 8 and opened to the free rocker arm 9 in correspondence to the guide hole 36 and in parallel to the rocker shaft 6, and the cylindrical bottomed restricting pin 29 abuuting against the other end of the second change-over pin 28 is slidably received in the second guide hole 37. The restricting pin 29 is disposed with its opened end turned to a closed end of the second guide hole 37, and at that opened end, a collar 29*a* protruding radially outwardly is in slidable contact with an inner surface of the second guide hole 37. Th return spring 30 is mounted in compression between the closed end of the second guide hole 37 and a closed end of the restricting pin 29, so that the individual pins 27, 28 and 29 abutting against one another are biased toward the hydraulic pressure chamber 32 by a spring force of the return spring 30. Furthermore, the closed end of the second guide hole 37 is provided with a communication bore 38 for venting air and an oil.

The inner surface of the second guide hole 37 is fitted with a retaining ring 40 which is capable of engaging the collar 29*a* of the restricting pin 29 to inhibit slipping of the restricting pin 29 out of the second guide hole 37. The fitting position of the retaining ring 40 is determined so that the restricting pin 29 is prevented from further moving from a state in which it abuts against the free arm 9 at a location corresponding to between the free rocker arm 9 and the second drive rocker arm 8 toward the free rocker arm 9.

With such connection change-over mechanism 10, an increase in hydraulic pressure in the hydraulic pressure chamber 32 causes the first change-over pin 27 to be fitted into the guide hole 36, while causing the second change-over pin 28 to be fitted into the second guide hole 37, whereby the rocker arms 7 to 9 are connected. If the hydraulic pressure in the hydraulic pressure chamber 32 is reduced, the spring force of the return spring 30 allows the first change-over pin 27 to be returned to a position in which the portion thereof abutting against the second change-over pin 28 corresponds to between the first drive rocker arm 7 and the free rocker arm 9, while allowing the second change-over pin 28 to be returned to a position in which the portion thereof abutting against the restricting pin 29 corresponds to between the free rocker arm 9 and the second drive rocker arm 8, whereby the connection of the rocker arms 7 to 9 is released.

Figure 5:
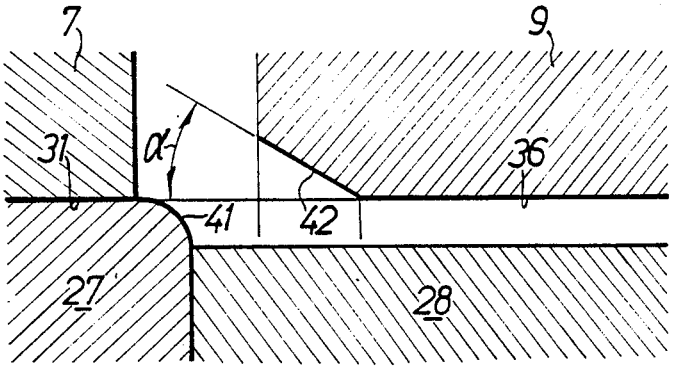

In the connection change-over mechanism 10, in order to smoothly and reliably perform fitting of the first change-over pin 27 into the guide hole 36 in the connecting operation of the connection change-over mechanism 10, a curved chamfer 41 is provided around the entire peripheral edge at an end of the first change-over pin 27 closer to the free rocker arm 9, and a tapered chamfer 42 is provided around a peripheral edge at the opened end of the guide hole 36 closer to the first drive rocker arm 7, as shown in FIG. 5. An inclined angle $\alpha$ of the tapered chamfer 42 with respect to its axis is set, for example, at 20 or 30 degrees. In addition, in order to smoothly and reliably perform fitting of the second change-over pin 28 into the second guide hole 37, a curved chamfer 43 is provided around the entire peripheral edge at an end of the second change-over pin 28 closer to the second drive rocker arm 8, and a tapered chamfer 44 having an inclined angle $\alpha$ set, for example, at 20 or 30 degree is provided around a peripheral edge at the opened end of the second guide hole 37 closer to the free rocker arm 9. The rocker arms 7 to 9 and the pins 27 to 29 may be hardened through a thermal treatment or surface treatment for the purpose of improvement in rigidity.

Now, the outside diameters of the change-over pins 27 and 28 and the restricting pin 29 as well as the inside diameters of the first guide hole 31, the guide hole 36 and the second guide hole 37 are determined with an accuracy of about $\mu$m in orer to reliably perform the connecting operation. If the outside diameter of the rocker shaft 6 is represented by D1; the inside diameter of the support hole 7*a* in the first drive rocker arm 7 is by D2; the inside diameter of the support hole 9*a* in the free rocker arm 9 is by D2'; the outside diameter of the first change-over pin 27 is by D3; the outside diameter of the second change-over pin 28 is by D3'; the inside diameter of the first guide hole 31 is by D4; the inside diameter of the guide hole 36 is by D4'; the distance between axes of the support hole 7*a* and the first guide hole 31 is by L1; and the distance between axes of the support hole 9*a* and th guide hole 36 is by L1', these dimensions D1 to D4, D2' to D3', L1 and L1' are determined, for example, in the following manner:

$$D1 = 17^{-0.006}_{-0.017}\ \text{mm}\phi$$

$$D2 = D2' = 17^{+0.030}_{+0.019}\ \text{mm}\phi$$

$$D3 = D3' = 10^{-0.005}_{-0.010}\ \text{mm}\phi$$

$$D4 = 10^{+0.009}_{0}\ \text{mm}\phi$$

$$L1 = L1' = 24^{+0.015}_{-0.015}\ \text{mm}\phi$$

If the individual dimensions are determined with a good accuracy in this manner, and with the individual rocker arms 7 to 9 assembled to the rocker shaft 6, misalignments may be produced in the individual rocker arms 7 to 9 due to addition of dimensional tolerances in an assembled condition. More specifically, the rocker arms 7 to 9 may be misaligned from one another in a plane including the axes of the rocker shaft 6 and the pins 27 and 28 and in a plane including the axes of the cam shaft 2 and the pins 27 and 28 to produce misalignments of the axes of the first guide hole 31, the guide hole 36 and the second guide hle 37, so that fitting of the first change-over pin 27 into the guide hole 36 as well as fitting of the second change-over pin 28 into the second guide hole 37 may be impossible. Thereupon, the inside diameter of the guide hole 36 is determined at a value larger than the inside diameters of the first and second guide holes 31 and 37, thereby ensuring that fitting of the first change-over pin 27 into the guide hole 36 as well as fitting of the second change-over pin 28 into the second guide hole 37 can be reliably performed.

The misalignment will now be considered between the first guide hole 31 and the guide hole 36 due to the misalignment of the rocker arms 7 to 9 in the plane including the axes of the rocker shaft 6 and the pins 27 to 29. In this case, when the first drive rocker arm 7 and the free rocker arm 9 are misaligned from each other, a diameter E of a circle inscribed with a section in which the first guide hole 31 and the guide hole 36 are superposed on each other is the outside diameter of the pin movable between the first guide hole 31 and the guide hole 36, as shown in FIG. 6A, and determination of a difference between such dimension E and the outside diameter D1 of the first change-over pin 27 makes it possible to judge whether fitting of the first change-over pin 27 into the guide hole 36 is possible or not.

Thereupon, the dimension E is first calculated in a normal condition in which among pairs of straight lines representing inner surfaces of the support holes 7a and 9a, respective ones closer to the first guide hole 31 and the guide hole 36 are level with each other in the plane including the axes of the rocker shaft 6 and the first and second change-over pins 27 and 28, as shown in FIG. 6. Thus, the minimum value of the dimension E in such normal condition is when ones of the dimensions D2 and L1 associated with the first drive rocker arm 7 and the dimensions S2′ and L1′ associated with the free rocker arm 9 are the maximum values within tolerances, and the others are the miminum values within tolerances. Thereupon, the dimension E, when the dimensions D2 and L1 are the maximum values and the dimensions D2′ and L1′ are the minimum values, is determined in the following equation:

$$E-(L1'-D2'/2+D4'/2)-(L1-D2/2-D4/2)$$

In this case, L1′=(24−0.015); L1=(24+0.015); D2′=(17+0.019); and D2=(17+0.030) and hence, E=−0.0245+(D4+D4′)/2. Here, if D4=D4′=10, E=9.9755 mm, and the difference from the outside diameter D3 of the first change-over pin 27 amounts to −19.5 μm.

Thus, the minimum value of the dimension E is of 9.9755 mm ϕ in the normal condition due to the misalignment of the first guide hole 31 and the guide hole 36 attendant on the misalignment of the rocker arms 7 and 9 in the plane including the axes of the rocker shaft 6 and the pins 27 to 29, and a deviation from the actual outside diameter D3 of the first change-over pin 27 is of −19.5 μm. Accordingly, if D4=D4′, then the fitting of the first change-over pin 27 into the guide hole 36 may be impossible.

Consideration will be given of the case where the inside diameter D4′ of the guide hole 36 is set larger than the inside diameter D4 of the first guide hole 31 according to the present invention, for example, the case where $$D4' = 10^{+0.076}_{+0.067}\ \text{mm}\phi.$$

If the D4′ is determined in this manner, the dimension E in the normal condition (a condition as shown in FIG. 6) is of 10.009 mm ϕ, and the deviation from the outside diameter D3 of the first change-over pin 27 is of +14.0 μm. When the condition shown in FIG. 6 is changed to a condition (as shown in FIG. 6C) in which the free rocker arm 9 is misaligned or deviated from the rocker shaft 6 toward the base end (the left side in FIG. 6) by a clearance between the rocker shaft 6 and the free rocker shaft 9, i.e., by the maximum value of 47 μm, the dimension E is believed to be minimum and thus, is of 9.962 mm ϕ, and the deviation from the outside diameter D3 of the first change-over pin 27 is of −33 μm. Therefore, the free rocker arm 9 can be moved by 47 μm relative to the rocker shaft 6 and hence, even if the relationship in position between the first guide hole 31 and the guide hole 36 is in a condition as shown in FIG. 6C, fitting, if slightly, of the leading end of the first change-over pin 27 into the guide hole 36 enables the free rocker arm 9 to be rotated in response to the advancing of the first change-over pin 27 to provide a condition as shown in FIG. 6B, so that the connection is possible of the first drive rocker arm 7 with the free rocker arm 9 by the fitting of the first change-over pin 27 into the guide hole 36.

Consideration will now be given of misalignment of the rocker arms 7 and 9 in the plane including the axes of the cam shaft 2 and the pins 27 to 29 with reference to FIG. 7. In this case, if the distance from the upper surface of the cam slipper 11 of the first drive rocker arm 7 to the axis of the first guide hole 31 is represented by L2; the distance from the upper surface of the cam slipper 13 of the free rocker arm 9 to the axis of the guide hole 36 is by L2′; and the acceptable difference in level between the circular base portion 3b of the lower speed cam 3 and circular base portion 5b of the higher speed cam 5 is by L3, then the individual dimensions L2, L2′ and L3 are, for example, determined as follows:

$$L2 = L2' = 11.67^{+0.015}_{-0.015}\ \text{mm}\phi$$

$$L3 = +20\ \mu\text{m}$$

With the dimensions L2, L2′ and L3 set in this manner, and suppose that L3=0 and the tappet clearance is also zero, the diameter E′ of a circle inscribed with a section of overlapping of the first guide hole 31 and the guide hole 36 is calculated in the following equation:

$$E'=(L2'+D4'/2)-(L2-D4/2)$$

The minimum value of the dimension E′ in such condition is when the dimension L2 associated with the first drive rocker arm 7 is of the maximum value within a tolerance, and the dimension L2′ associated with the free rocker arm 9 is of the minimum value within a tolerance, i.e., L2=11.65+0.015, and L2′=11.65−0.015. If D4′=D4=10 at such time, E′=9.97 mm, and the deviation from the outside diameter D3 of the first change-over pin 27 is of −25 μm. Accordingly, fitting on the first change-over pin 27 into the guide hole 36 may be impossible.

Thereupon, if $$D4' = 10^{+0.076}_{+0.067}\ \text{mm}\phi$$

in the same manner as described above, E′=10.008 mm, and the deviation is of +8.5 μm and hence, fitting of the first pin 27 into the guide hole 36 is possible.

The difference in level L3=±20 μm as described above and hence, for example, when L3=+20 μm on the basis of the free rocker arm 9, the deviation 20 μm increases to amount to −11.5 μm. However, the deviation portion is absorbed, so that fitting of the first change-over pin 27 into the guide hole 36 is possible, because the free rocker arm 9 can be moved down while depressing the piston 19 of the lost motion mechanism 17 downwardly. Even when L3=−20 μm on the basis of the free rocker arm 9, the deviation is of −11.5 μm. However, such deviation is absorbed to enable fitting of the first change-over pin 27 into the guide hole 36, because the tappet clearance between the first drive rocker arm 7 and the lower speed cam 3 may be set, for example, at a value on the order of 170 to 190 μm.

Even if the deflection of each of the respective circular base portions 3b and 5b of the cams 3 and 5 is on the order of *30* μm, for example, the amount of such deflection is absorbed as a result of the free rocker arm 9 moved down in the same manner as described above, so that fitting of the first change-over pin 27 into the guide hole 36 is possible.

The same is true of fitting of the second change-over pin 28 into the second guide hole 37, and setting of the inside diameter of the guide hole 36 at a value larger than the inside diameter of the second guide hole 37 ensures that fitting of the second change-over pin 28 into the second guide hole 37 will be reliably performed.

Now, if the individual dimensions are determined as described above, the lift curve of each of the intake valves 1*a* and 1*b* will be misaligned from an established curve due to clearance between the guide hole 36 and the first and second change-over pins 27 and 28 when the connecting operation by the connection change-over mechanism 10. Thereupon, allowing for the clearances between the guide hole 36 and the first and second change-over pins 27 and 28, the configuration of the higher speed cam 5 may be determined so as to be slightly larger than that determined when the inside diameter of the guide hole 36 has been set at the same value as the inside diameters of the first and second guide holes 31 and 37.

Referring to FIGS. 8 and 9, the free rocker arm 9 has recesses 45 and 46 made at the sides thereof opposed to the first and second drive rocker arm 7 and 8, respectively, by reducing the wall thickness for reduction in weight, and spring pins 47 and 48 are press-fitted into and secured to the sides of the first and second drive rocker arms 7 and 8 opposed to the recesses 45 and 46 to enter the recesses 45 and 46, respectively. The amount of relatively swinging movement of the free rocker arm 9 and the first and second rocker arms 7 and 8 is restricted by these recesses 45 and 46 and the spring pins 47 and 48, but the first and second drive rocker arms 7 and 8 in slidable contact with the lower speed cams 3 and 3 and the free rocker arm 9 in slidable contact with the higher speed cam 5 are relatively swung in a lower speed operation mode. Therefore, the recesses 45 and 46 are formed at a size such that they would not interfer with the relatively swinging movements of the first and second drive rocker arms 7 and 8 and the free rocker arm 9 in the lower speed operation mode.

In assembling the individual rocker arms 7 to 9 to the rocker shaft 6, a dummy shaft 49 and an assembling jig 50 are prepared. The dummy shaft 49 is cylindrically formed so that it may be inserted through the rocker arms 7 to 9 in place of the rocker shaft 6. The outside diameter of the dummy shaft 49 is determined such that the dummy shaft 49 may be pushed by the end of the rocker shaft 65 and easily slipped out of the rocker arms 7 to 9 upon insertion of the rocker shaft 6 through the rocker arms 7 to 9.

Referring also to FIG. 10, the assembling jig 50 has, at one side thereof, first and second notches 51 and 52 into which the tappet screws 16 and 16 may be fitted, and is formed into a flat plate so that it may be clamped between lock nuts 54 and the first and second drive rocker arms 7 and 8. In addition, a substantially L-shaped tab 53 is integrally formed in an upwardly bent manner at the other side of the assembling jig 50 in a plane perpendicular to axes of the tappet screws 16 engaged in the corresponding notches 51 and 52.

A system for supplying an oil into the valve operating system will be described below with reference to FIG. 11, wherein portions associated with the intake-side valve operating system are designated by the reference characters with a suffix i, while portions associated with the exhaust-side valve operating system are designated by the reference characters with a suffix e.

An oil gallery 68 is connected through a relief valve 65, an oil filter 66 and an oil cooler 68 to a discharge port of an oil pump 64 for pumping an oil from an oil pan, so that a hydraulic oil pressure is supplied from the oil gallery 68 to the connection change-over mechanisms 10*i* and 10*e*, and a lubricating oil is supplied from the oil gallery 68 to portions which are to be lubricated.

A directional control valve 69 is connected to the oil gallery 68 for changing-over the hydraulic pressure passed through the filter 70 provided on the way of the oil gallery 68 between higher and lower levels for supplying thereof, and the oil feed passages 35*i* and 35*e* within the rocker shafts 6*i* and 6*e* are connected to the oil gallery 68 through the directional control valve 69. Furthermore, passage defining members 72*i* and 72*e* are fixedly disposed above the cam shafts 2*i* and 2*e* to extend in parallel to the cam shafts 2*i* and 2*e*, and provided with lower speed lubricating passages 74*i* and 74*e* closed at its opposite ends and higher speed lubricating passages 75*i* and 75*e* communicating with the oil feed passages 35*i* and 35*e* through restrictions 76*i* and 76*e*, respectively, both of the lower and higher speed lubricating passages being in parallel to each other.

An oil passage 77 having a restriction 70 on the way thereof diverges from the oil gallery 68 upstream the oil filter 70 and communicates with the lower speed lubricating passages 74*i* and 74*e* through a branched oil passage 80 directed to both of the intake- and exhaust-side valve operating systems.

The lower speed lubricating passages 74*i* and 74*e* serve to supply the lubricating oil to slidable-contact portions of the cams 3, 3 and 5 with the rocker arms 7*i*, 7*e*, 8*i*, 8*e*, 9*i* and 9*e* as well as to cam journal portions of the cam shafts 2*i* and 2*e*. To this end, lower surfaces of the passage defining members 72*i* and 72*e* are provided with lubricating-oil ejecting holes 82*i* and 82 at places corresponding to the lower speed cams 3 and 3 and the higher speed cam 5 in communication with the lower speed lubricating passages 74*i* and 74*e*, respectively, and also provided with lubricating oil supply passages 83*i* and 83*e* communicating with the lower speed lubricating passages 74*i* and 74*e* to supply the lubricating oil to the cam journal portions of the cam shafts 2*i* and 2*e*, respectively.

The higher speed lubricating passages 75*i* and 75*e* serve to supply the lubricating oil to slidable-contact portions of the higher speed cam 5 with the free rocker arms 9*i* and 9*e*. For this purpose, lower surfaces of the passage defining members 72*i* and 72*e* are provided with lubricating-oil ejecting holes 84*i* and 84*e* at places corresponding to the higher speed cam 5 in communication with the higher speed lubricating passages 75*i* and 75*e*, respectively.

The directional control valve 69 is changeable between a state which permits a higher hydraulic pressure merely causing the connecting operation of each of the connection change-over mechanisms 10*i* and 10*e* to be supplied to the oil feed passages 35*i* and 35*e*, and a state which permits a lower hydraulic pressure causing the disconnection of the connection change-over mechanisms 10*i* and 10*e* to be supplied to the oil feed passages 35*i* and 35*e*.

In a higher oil pressure supplying mode, the lubricating oil supplied into the higher speed lubricating passages 75*i* and 75*e* can be ejected through the lubricating oil ejecting holes 84*i* and 84*e* to effect the lubrication of those slidable contact portions of the higher speed cam 5 with the free rocker arms **9*i* and 9*e* which are particularly increased in surface pressure. Now, when the directional control valve 69 is operated for change-over from the lower oil pressure supplying mode to the higher oil pressure supplying mode, there is a somewhat time lag until the oil pressures in the higher speed lubricating passage 75*i* and 75*e* is increased by the restrictions 76*i* and 76*e* and hence, there is a somewhat time lag until the lubricating oil is ejected through the lubricating oil ejecting holes 84*i* and 84*e*. Since the lubricating oil ejecting holes 82*i* and 82*e* leading to the lower speed lubricating passages 74*i* and 74*e* are also disposed at the places corresponding to the slidable contact portions of the higher speed cam 5 with the free rocker arms 9*i* and 9*e*, however, the lubricating oil cannot be deficient in the slidable contact portions of the higher speed cam 5 with the free rocker arms 9*i* and 9*e* even if there is a somewhat time lag, as described above. In addition, when a situation occurs in which the directional control valve 69 is brought into the lower oil pressure supplying mode with the individual pins 27, 28 and 29 in the connection change-over mechanisms 10*i* and 10*e* remaining locked, the surface pressures of the slidable contact portions of the higher speed cam 5 and the free rocker arms 9*i* and 9*e* are increased as in the higher speed operation mode, but even at this time, the lubricating oil is ejected to the slidable contact portions of the higher speed cam 5 and the free rocker arms 9*i* and 9*e* through the lubricating oil ejecting holes 82*i* and 82*e* leading to the lower speed lubricating passages 74*i* and 74*e***, so that sufficient lubrication can be effected.

The operation of this embodiment will be described below. In assembling the rocker arms 7 to 9 to the rocker shaft 6, the individual rocker arms 7 to 9 are previously prepared in a unit construction prior to such assembling, as shown in FIG. 9. More specifically, the first and second drive rocker arms 7 and 8 are previously connected by the assembling jig 50 by inserting the dummy shaft 49 through the rocker arms 7 to 9, clamping the assembling jig 50 between the lock nuts 54 and 54 and the first and second drive rocker arms 7 and 8 with the first and second notches 51 and 52 fitted over the tappet screws 16 and 16 of the first and second drive rocker arms 7 and 8, and tightening the lock nuts 54 and 54. In this case, individual parts constituting the connection change-over mechanism 10, i.e., the first change-over pin 27, the second change-over pin 28, the restricting pin 29 and the return spring 30 are assembled to the corresponding portions of the rocker arms 7 to 9.

When the rocker shaft 6 is inserted into the rocker arms 7 to 9 assembled in the unit construction in this manner, the dummy shaft 49 is urged by the end of the rocker shaft 6 and withdrawn out of the rocker arms 7 to 9. In this way, the rocker arms can be assembled to the rocker shaft 6, and therefore, assembling of the rocker arms 7 to 9 can be easily and efficiently carried out. The removal of the assembling jig 50 is effected as the lock nuts 54 and 54 are loosened in controlling the tappet clearances by ajustment of the advance and retreat positions of tappet screws 16 and 16. Thus, when the lock nuts 54 and 54 have been loosened, the assembling jig 50 can be removed from the first and second drive rocker arms 7 and 8 by grasping the tab 53 with fingers to pull the assembling jig 50.

Description will be made of the operation after completion of the assembling of the rocker arms 7 to 9 to the rocker shaft 6. In the lower speed operation of the engine, the hydralic oil pressure in the hydraulic pressure chamber 32 is free in the connection change-over mechanism 10, and the pins 27 to 29 are in their disconnecting states in which they have been moved at the maximum toward the hydraulic pressure chamber 32 by the spring force of the return spring 30. In this condition, the abutting surfaces of the first and second change-over pins 27 and 28 and the restricting pin 29 are in the locations corresponding to between the free rocker arm and the second drive rocker arm 8. Therefore, the rocker arms 7 to 9 are in their states capable of being relatively angularly displaced.

In such disconnected condition, the rotation of the cam shaft 2 causes the first and second rocker arms 7 and 8 to be swung in accordance with sliding movement of the lower speed cams 3 and 3 thereon and therefore, the engine valves **1*a* and 1*b* are opened and closed in a timing and lift amount depending upn the configuration of the lower speed cams 3 and 3. In this case, the free rocker arm 9 is swung in accordance with sliding movement of the higher speed cam 5 thereon, but such swinging movement would not exert any influence on the first and second drive rocker arms 7 and 8**.

In the higher speed operation of the engine, a higher oil pressure is supplied into the hydraulic pressure chamber 32. This causes the first and second change-over pins 27 and 28 and the restricting pin 29 to be moved toward the connecting positions against the spring force of the return spring 30. As a result, the first change-over pin 27 is fitted into the guide hole 36, while the second change-over pin 28 is fitted into the second guide hole 37, whereby the rocker arms 7 to 9 are connected. At this time, the amount of swinging movement of the free rocker arm 9 in sliding contact with the higher speed cam 5 is largest and hence, the first and second drive rocker arms 7 and 8 swing with the free rocker arm 9, so that the intake valves **1*a* and 1*b* are opened and closed in a timing and lift amount depending upon the configuration of the higher speed cam 5**.

Furthermore, in this higher speed operation and since the configuration of the higher speed cam 5 is determined allowing for the clearances between the guide hole 36 and the first and second change-over pins 27 and 28, the lift curves of the intake valves **1*a* and 1*b*** cannot be misaligned from intended profils even if such clearances are provided. This enables a desired condition of operation to be provided.

During such connecting operation, the axes of the first guide hole 31, the guide hole 36 and the second guide hole 37 may not be completely aligned together in some cases, due to the tolerances of production of the rocker arms 7 to 9. However, fitting of the leading end of the first change-over pin 27 into the guide hole 36 as well as fitting of the leading end of the second change-over pin 28 into the second guide hole 37 are insured despite the mislignment of the axes, because the curved chamfer 41 is provided around the entire peripheral edge at the end of the first change-over pin 27 closer to the free rocker arm 9; the tapered chamfer 42 is provided around the peripheral edge at the opened end of the guide hole 36 closer to the first drive rocker arm 7; the curved chamfer 43 is provided around the entire peripheral edge at the end of the second change-over pin 28 closer to the second drive rocker arm 8, and the tapered chamfer 44 is provided around the peripheral edge at the opened end of the second guide hole 37 closer to the free rocker arm 9. Moreover, the first change-over pin 27 can be reliably fitted into the guide hole 36, while the second change-over pin 28 can be reliably fitted into the second guide hole 37, as described above, because the inside diameter of the guide hole 36 has been set larger than the inside diameters of the first guide hole 31 and the second guide hole 37.

Now, when the free rocker arm 9 is in sliding contact with the circular base portion 5*b* of the higher speed cam 5, the second spring 22 in the lost motion mechanism 17 is in a state of its free length, and there is a clearance between the piston 19 and the retainer 25. Accordingly, it is possible to provide a slightly swinging movement of the three rocker arm 9 while compressing the first spring 21 having the spring constant set at a relatively small value, and a slight force provided by the axial movement of the first change-over pin 27 enables the free rocker arm 9 to be slightly pushed down or up to aid in the connecting operation of the connection change-over mechanism 10.

In addition, in the above higher speed operation, the cam slipper 13 of the free rocker arm 9 should be reliably brought into sliding contact with the higher speed cam 5, because the intake valves 1*a* and 1*b* are driven for opening and closing by the free rocker arm 9, and the lost motion mechanism 17 is required to urge the free rocker arm 9 toward the cam shaft 2 by a relatively strong spring force. When the raised portion 5*a* of the higher speed cam 5 is in sliding contact with the cam slipper 13, the first spring 21 having the relatively small spring constant is in its compressed state until the piston 19 is allowed to abut against the retainer 25, and the piston 19 is biased toward the higher speed cam 5 by the second spring having the relatively large spring constant. Accordingly, the free rocker arm 9 is brought into sliding contact with the higher speed cam 5 by the relatively large spring force, thereby providing a higher lift load.

Furthermore, the lost motion mechanism 17 is assembled in the unit construction by sequentially inserting the second spring 22, the retainer 25, the first spring 21 and the piston 19 into the guide member 18 and securing the stopper 20 to the guide member 18, and the lost motion mechanism 17 of unit construction may be merely fitted into the mounting hole 23 to complete the assembling to the engine body E. Therefore, it is possible to extremely faciliate the assembling operation. In addition, since the abutment 19*a* of the piston 19 in the lost motion mechanism 17 is formed in the tapered manner, the lost motion mechanism 17 can be disposed in proximity to the pivoted portion of the free rocker arm 9 on the rocker shaft 6 and hence, the inertial weight of the free rocker arm 9 can be reduced, thereby providing a reduction in driving force. Moreover, the weight of the piston 19 can be reduced by forming the air vent hole 26 into a cross-shape, and this also reduces the inertial weight.

During connecting operation of the connection change-over mechanism 10, a thrust force acts on the first and second change-over pins 27 and 28, but the pins 27 and 28 each have an improved rigidity to withstand such thrust force, because they are each formed into a solid column-like configuration. Furthermore, since the connection change-over mechanism 10 is disposed so that the axis C lies at a place where the wall thicknesses of the rocker arms 7 to 9 are reduced into substantially one half, the wall thicknesses around the first guide hole 31, the guide hole 36 and the second guide hole 37 provided in the rocker arms 7 to 9 are substantially equalized to improve the rigidity, thereby avoiding the deformation of these holes 31, 37 and 36 to the utmost. Accordingly, it is possible to improve the entire rigidity of the connection change-over mechanism 10 and assure a normally smooth operation.

Additionally, since the retaining ring 40 engageable with the restricting pin 29 is fitted to the inner surface of the second guide hole 37 in the connection change-over mechanism 10, the restricting pin 29 is reliably prevented from being sprung out of the second guide hole 37 by the return spring 30 during maintenance of the connection change-over mechanism 10, even if the force for urging the restricting pin 29 is released.

Further, because the relatively swinging movements of the free rocker arm 9 and the first and second drive rocker arms 7 and 8 are restricted within a range in which the spring pins 47 and 48 are movable in the recesses 45 and 46, the rocker arms 7 to 9 are prevented from largely relatively swinging during maintenance or the like, thereby preventing falling-off of the parts, i.e., the first change-over pin 27 and the second change-over pin 28, respectively assembled to the rocker arms 7 to 9 to constitute the connection change-over mechanism 10. This excludes inadvertent assembling of them after falling-off thereof.

Although the above embodiment has been described with the cam slippers 11 to 13 integrally provided on the rocker arms respectively, the present invention is applicable to a construction in which members made a different material are secured to the corresponding rocker arms 7 to 9 to form cam slippers. In this case, the axis C of the connection change-over mechanism 10 may be set so that the distance to the slidable contact portions with the cams 3, 3 and 5 in the rocker arms 7 to 9 excluding the cam slippers may be smaller than the distance to the lower surfaces of the rocker arms 7 to 9 on a straight line extending through axes of such slidable contact portions and the cam shaft 2. This improves the rigidities of the rocker arms 7 to 9.

Although the second change-over pin 28 in the connection change-over mechanism 10 comprises the larger diameter portion coaxially connected to the smaller diameter portion in the above-described embodiment, the second change-over pin 28 may be formed into a solid column-like configuration having the same outside diameter over the axially entire length thereof, as shown in FIG. 12. If doing so, it is possible to reduce the surface pressures of the abutting surfaces of the first and second change-over pins 27 and 28.

What is claimed is:

1. A valve operating system for internal combustion engines, comprising a free cam follower which is disposed between first and second drive cam followers operatively connected to engine valves and which is capable of becoming free relative to the engine valves; first and second guide holes provided respectively in said first and second drive cam followers with their axes coaxial to each other, said first and second guide holes opened to said free cam follower; a double open-ended guide hole provided in said free cam follower coaxial to the axes of said first and second guide holes; a first change-over pin axially slidably received in said first guide hole and adapted to be fitted into said open-ended guide hole; a second change-over pin axially slidably received in said open-ended guide hole with one end thereof abutting against said first change-over pin, said second change-over pin being adapted to be fitted into said second guide hole; and a restricting pin axially slidably received in said second guide hole while being spring-biased toward said second change-over pin, with one end thereof abutting against the other end of said second change-over pin, wherein said open-ended guide hole is formed to have an inside diameter larger than those of said first and second guide holes.

2. A valve operating system for internal combustion engines according to claim 1, further including curved chamfers provided around the entire peripheral edge at an end of said first change-over pin closer to said free cam follower and around the entire peripheral edge at an end of said second change-over pin closer to said second drive cam follower, respectively.

3. A valve operating system for internal combustion engines according to claim 1 or 2, further including tapered chamfers provided around a peripheral edge at an opened end of said open-ended guide hole closer to said first drive cam follower and around a peripheral edge at an opened end of said second guide hole closer to said free cam follower, respectively.

4. A valve operating system for internal combustion engines according to claim 1 or 2, wherein the configuration of the cam in sliding contact with the free cam follower is determined allowing for clearances between the open-ended guide hole in said free cam follower and said first and second change-over pins.

5. A valve operating system for internal combustion engines according to claim 1, further including a pin provided on one of opposed side surfaces of the adjacent cam followers, and a recess provided on the other side surface to permit entering of said pin thereinto, thereby restricting the range of relatively swinging movement of said adjacent cam followers.

6. A valve operating system for internal combustion engines according to claim 1, further including a cam slipper provided on each of the cam followers in sliding contact with the corresponding cams, and wherein each of said first and second change-over pins are formed into a solid column-like configuration, and said first guide hole, said open-ended guide hole and said second guide hole are made in the corresponding cam followers at locations where said cam slippers are provided, with the axes of all the guide holes disposed at locations where the wall thickness of each of the cam followers, including said cam slipper, is approximately one half of the diameter of each of the respective guide holes.

7. A valve operating system for internal combustion engines according to claim 3, wherein the configuration of the cam in sliding contact with the free cam follower is determined allowing for clearances between the open-ended guide hole in said free cam follower and said first and second change-over pins.

* * * * *